US010378852B1

(12) United States Patent
Rotramel

(10) Patent No.: US 10,378,852 B1
(45) Date of Patent: Aug. 13, 2019

(54) ARCHERY BOW HAVING AN OPERATIVE RISER

(71) Applicant: Stephen D. Rotramel, Moline, IL (US)

(72) Inventor: Stephen D. Rotramel, Moline, IL (US)

( * ) Notice: Subject to any disclaimer, the term of this patent is extended or adjusted under 35 U.S.C. 154(b) by 0 days.

(21) Appl. No.: 15/969,391

(22) Filed: May 2, 2018

(51) Int. Cl.
*F41B 5/00* (2006.01)
*F41B 5/14* (2006.01)
*F41B 5/10* (2006.01)

(52) U.S. Cl.
CPC ..... *F41B 5/0031* (2013.01); *F41B 5/00* (2013.01); *F41B 5/0052* (2013.01); *F41B 5/14* (2013.01); *F41B 5/10* (2013.01)

(58) Field of Classification Search
CPC ..... F41B 5/00; F41B 5/10; F41B 5/14
See application file for complete search history.

(56) References Cited

U.S. PATENT DOCUMENTS 3,913,556 A * 10/1975 Palma ..... F41B 5/0031 124/23.1
4,478,202 A * 10/1984 Anderson ..... F41B 5/10 124/23.1
5,205,269 A * 4/1993 Guzzetta ..... F41B 5/0094 124/23.1
5,222,473 A * 6/1993 Lint ..... F41B 5/1449 124/1
5,445,139 A * 8/1995 Bybee ..... F41B 5/12 124/23.1
5,931,146 A 8/1999 Schrader

* cited by examiner

*Primary Examiner* — John A Ricci
(74) *Attorney, Agent, or Firm* — Neustel Law Offices

(57) ABSTRACT

A bow having a high throw weight and a low draw weight. The bow has an operative riser adapted to cause pivotal movement of an upper or lower limb. The operative riser includes a first end section connected to a first limb, a second end section connected to a second limb, and a central section connected between the first and second end sections, the first end section being fixedly connected to the central section and the second end section being pivotally connected to the central section. An actuating means is disposed within the central section to physically engage the second end section. A triggering means is connected to the actuating means to operably engage the actuating means and cause pivotal movement of the second limb. The pivotal movement changes a length between the distal ends of the limbs thus changing a draw or throw weight of the archery bow.

19 Claims, 4 Drawing Sheets

ARCHERY BOW HAVING AN OPERATIVE RISER

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to an archery bow and more specifically it relates to an archery bow having an operative riser for efficiently providing a high throw weight to a bow having a low draw weight.

Description of the Related Art

Any discussion of the related art throughout the specification should in no way be considered as an admission that such related art is widely known or forms part of common general knowledge in the field.

Archers and especially bow hunters generally try to shoot a bow that has the highest draw weight that they can physically pull back. The advantage of shooting a bow with a higher draw weight is that the bow is able to shoot the arrow at higher speeds, thus providing greater accuracy and more arrow penetration to the target. Also, there are generally requirements for minimum draw weights for hunting and it may be desired to have a higher draw weight for long range shooting or shooting competition events.

However, attempting to shoot a bow with too high of a draw weight can have various damaging effects, such as be damaging for shoulder or other joints, be dangerous in that the shooter may have a lack of control when attempting to pull too high of a draw weight, be difficult when the shooter is in an awkward position, such as in a tree or hunting stand thus more easily contributing to the hunter making noises to scare away targeted animals, and various other damaging or harmful effects. Because of the inherent problems with the related art, there is a need for a new and improved archery bow having an operative riser for efficiently providing a high throw weight to a bow having a low draw weight.

BRIEF SUMMARY OF THE INVENTION

A system for efficiently providing a high throw weight to a bow having a low draw weight. The invention generally relates to an archery bow having an operative riser which includes a first end section connected to a first limb, a second end section connected to a second limb, and a central section connected between the first and second end sections, the first end section being fixedly connected to the central section and the second end section being pivotally connected to the central section. An actuating means is disposed within the central section to physically engage the second end section. A triggering means is connected to the actuating means to operably engage the actuating means and cause pivotal movement of the second limb. The pivotal movement changes a length between the distal ends of the limbs thus changing a draw or throw weight of the archery bow.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
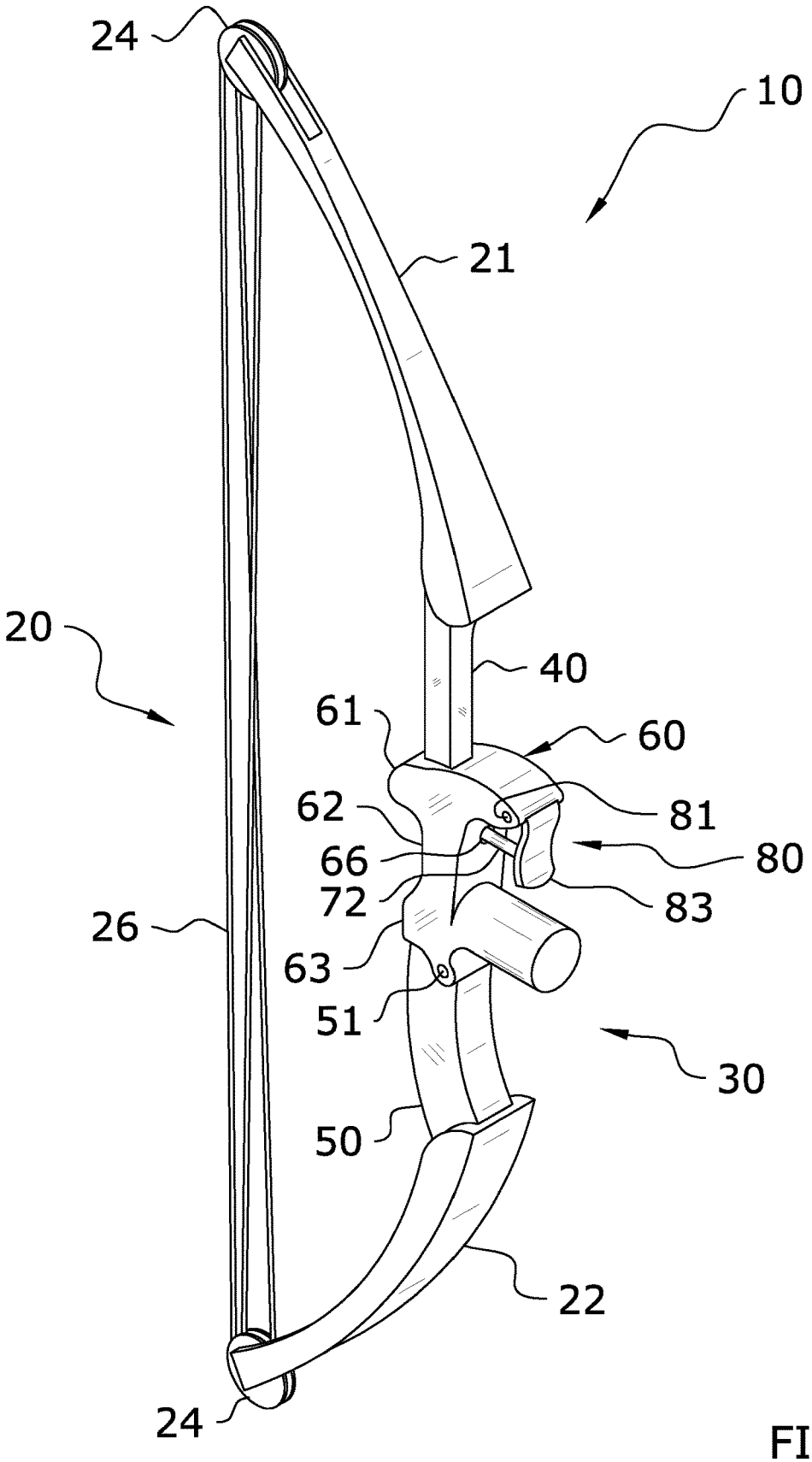
FIG. 1 is an upper perspective view of the present invention.

Turning now descriptively to the drawings, in which similar reference characters denote similar elements throughout the several views, FIGS. 1 through 4 of the present invention 10 illustrate a bow 10 having an operative riser 30 adapted to cause pivotal movement of an upper or lower limb 22. The operative riser 30 includes a first end section 40 connected to a first limb 21, a second end section 50 connected to a second limb 22, and a central section 60 connected between the first and second end sections 40, 50, the first end section 40 being fixedly connected to the central section 60 and the second end section 50 being pivotally connected to the central section 60.

An actuating assembly 70 is disposed within the central section 60 to physically engage the second end section 50. A triggering assembly 80 is connected to the actuating assembly 70 to operably engage the actuating assembly 70 and cause pivotal movement of the second limb 22. The pivotal movement changes a length between the distal ends of the limbs 21, 22 thus changing a draw or throw weight of the archery bow 20.

Various types of archery bows may be utilized with the present invention. FIGS. 1 through 5 illustrate a compound bow structure; however it is appreciated that a recurve or other type of bow may also be utilized. The archery bow 20 generally includes an operative riser 30 having a first end and a second end. A first limb 21 extends from the first end of the riser 30 and a second end extends from the second end of the riser 30. The angles of the limbs 21, 22 may be adjusted about the end sections 40, 50 of the riser 30 using conventional methods.

Preferably located at distal ends of each of the limbs 21, 22 are wheels 24 or cams for supporting the drawstring 26. Various other features may be utilized with the bow 20, such as sighting pins, stabilizers, etc. all which are conventional with different types of bows. The limbs 21, 22, wheels 24, and drawstring 26 may be of various structures and materials conventional to different types of archery bows. The present invention focuses around the operative riser 30 and thus the operative riser 30 will be discussed in detail below.

B. First End Section

The first end section 40 defines the first end of the riser 30 and is generally fixed in position relative the riser 30. Various materials may be utilized with the first end section 40 section as appreciated with conventional risers all which provide adequate support to the first limb 21. In the FIGS. 1 through 5, the first end section 40 is located on the upper part of the riser 30; however it is appreciated that the first end section 40 may be located on the lower part of the riser 30 to alternately connect to the lower limb 22.

It is appreciated that the first limb 21 may be adjusted about the first end section 40 of the riser 30 in various manners conventional to archery bows, such as through a limb pocket and bolt. The limb pocket and bolt are not shown and may be structured in various manners conventional with the art.

C. Second End Section

The second end section 50 defines the second end of the riser 30 and is generally pivotal in position relative the riser 30. An end portion of the second end section 50 preferably extends within the cavity of the central section 60 to be engaged by the actuating assembly 70. The second end section 50 is pivotally connected at a pivot point 51 to the central section 60 adjacent the end portion of the second end section 50 that extends within the central section 60.

Various materials may be utilized with the second end section 50 section as appreciated with conventional risers all which provide adequate support to the second limb 22. In the FIGS. 1 through 5, the second end section 50 is located on the lower part of the riser 30; however it is appreciated that the second end section 50 may be located on the upper part of the riser 30 to alternately connect to the upper limb 21.

It is appreciated that the second limb 22 may be adjusted about the second end section 50 of the riser 30 in various manners conventional to archery bows, such as through a limb pocket and bolt. The limb pocket and bolt are not shown and may be structured in various manners conventional with the art.

D. Central Section

The central section 60 interconnects the first end section 40 and the second end section 50 of the riser 30. The central section 60 generally includes a first portion 61, a handle portion 62 extending from the first portion 61, and a second portion 63 extending from the handle portion 62, wherein an internal cavity 65 extends throughout the central section 60 thus forming a substantially hollow structure. Various materials may be utilized with the central section 60 as appreciated with conventional risers all which provide adequate support.

The first portion 61 and the second portion 63 generally bulge outwards from the handle portion 62 thus providing upper and lower retaining mechanisms for the operator's hand upon the handle portion 62. The handle portion 62 may include various grips or have various structures to provide a comfortable and secure grip.

The first end section 40 is generally fixedly connected to an end of the central section 60, such as the upper end of the central section 60. The first end section 40 may further be integrally formed with the central section 60, thus comprising a one-piece integral structure. Alternately, the first end section 40 and the central section 60 may be separate structures secured together in a fixed and non movable structure.

The second end section 50 is pivotally connected to the central section 60. The second end section 50 generally extends through a channel-shaped end opening 68 of the central section 60 within the cavity to be in position for engagement with the actuating assembly 70. The second end section 50 is pivotally connected to the central section 60 adjacent the end opening 68.

E. Actuating Means

The actuating assembly 70 is preferably disposed within the internal cavity 65 of the central section 60; however it is appreciated that in alternate embodiment the actuating assembly 70 may be located partially within or outside of the internal cavity 65 of the central section 60. The actuating assembly 70 pivots the second end section 50 about the pivot point 51 thus pivoting the second limb 22 when triggered to adjust the distance between distal ends of the limbs and thus weight or force of the drawstring 26.

Generally, the actuating assembly 70 includes a master cylinder 71 which is engaged by a trigger and causes a slave cylinder 76 to engage the second end section 50 and pivot the second limb 22. The master cylinder 71 and the slave cylinder 76 may be comprised of various types of cylinders, such as pneumatic, hydraulic, etc.

The master cylinder 71 is generally located within the first portion 61 of the central section 60 and disposed horizontally so that an actuating first piston rod 72 extending from the master cylinder 71 extends horizontally forward through a front opening 66 of the central section 60 above the handle portion 62.

A connecting hose 74 extends through the handle portion 62 to fluidly connect the master cylinder 71 to the slave cylinder 76. The slave cylinder 76 is preferably located within the second portion 63 of the central section 60 below the handle portion 62 and also disposed horizontally.

The slave cylinder 76 is preferably positioned forwardly of the second end section 50 protruding within the internal cavity 65 to cause an actuating second piston rod 77 to move horizontally rearward to engage the end of the second end section 50. The second piston rod 77 preferably includes a wedge 78 extending from a distal end, the wedge 78 being tapered with the angular surface of the wedge 78 engaging the angular end of the second end section 50 when the second piston rod 77 is extended.

F. Trigger Means

The trigger assembly 80 is connected to the first portion 61 of the central section 60 and extends through a second front opening 67 of the first portion 61. The second front opening 67 is positioned forwardly of the first front opening 66 and generally above the first front opening 66. The trigger assembly 80 generally includes a pivotal connector 81 located within the internal cavity 65 of the first portion 61 of the central section 60 forwardly and adjacent the second front opening 67. Extending from the pivotal connector 81 is the trigger member 83.

The trigger member 83 being curved or spline-shaped to easily conform to the grip of the operator and being positioned forwardly of the handle portion 62 and in close proximity to the handle portion 62 so that the trigger member 83 may be operated when the user is holding the handle portion 62 with the drawstring 26 of the bow 20 in the drawn position. The distal end of the first piston rod 72 preferably engages the upper part of the trigger member 83 adjacent the pivotal connector 81, so that when the operator applies a rearward force to the lower part of the trigger member 83, the trigger member 83 moves the first piston rod 72 rearwardly within the master cylinder 71 to activate the master cylinder 71 and thus slave cylinder 76.

G. Operation of Preferred Embodiment

Figure 2:
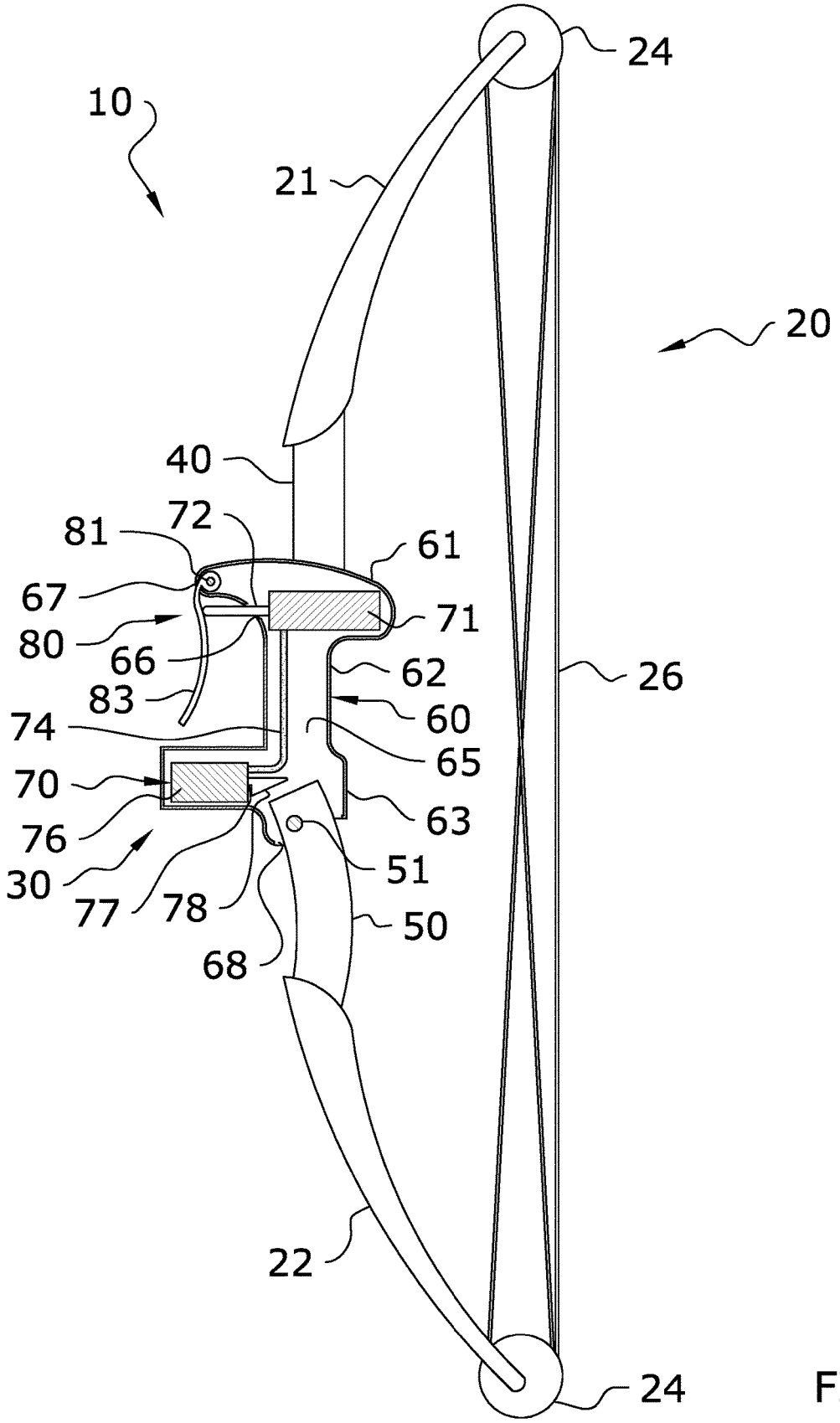
FIG. 2 is a partial side sectional view of the present invention with the drawstring in the rested position.

In use, the operator loads an arrow (not shown) onto the arrow rest and secures the rear end of the arrow to the drawstring 26 as is conventional with archery bows 20. The operator grasps the handle portion 62 of the riser 30 with one hand and pulls rearward upon the drawstring 26 with the other hand to move the drawstring 26 from a rested position as illustrated in FIGS. 1-2 to a drawn position as illustrated in FIGS. 3-4.

Figure 3:
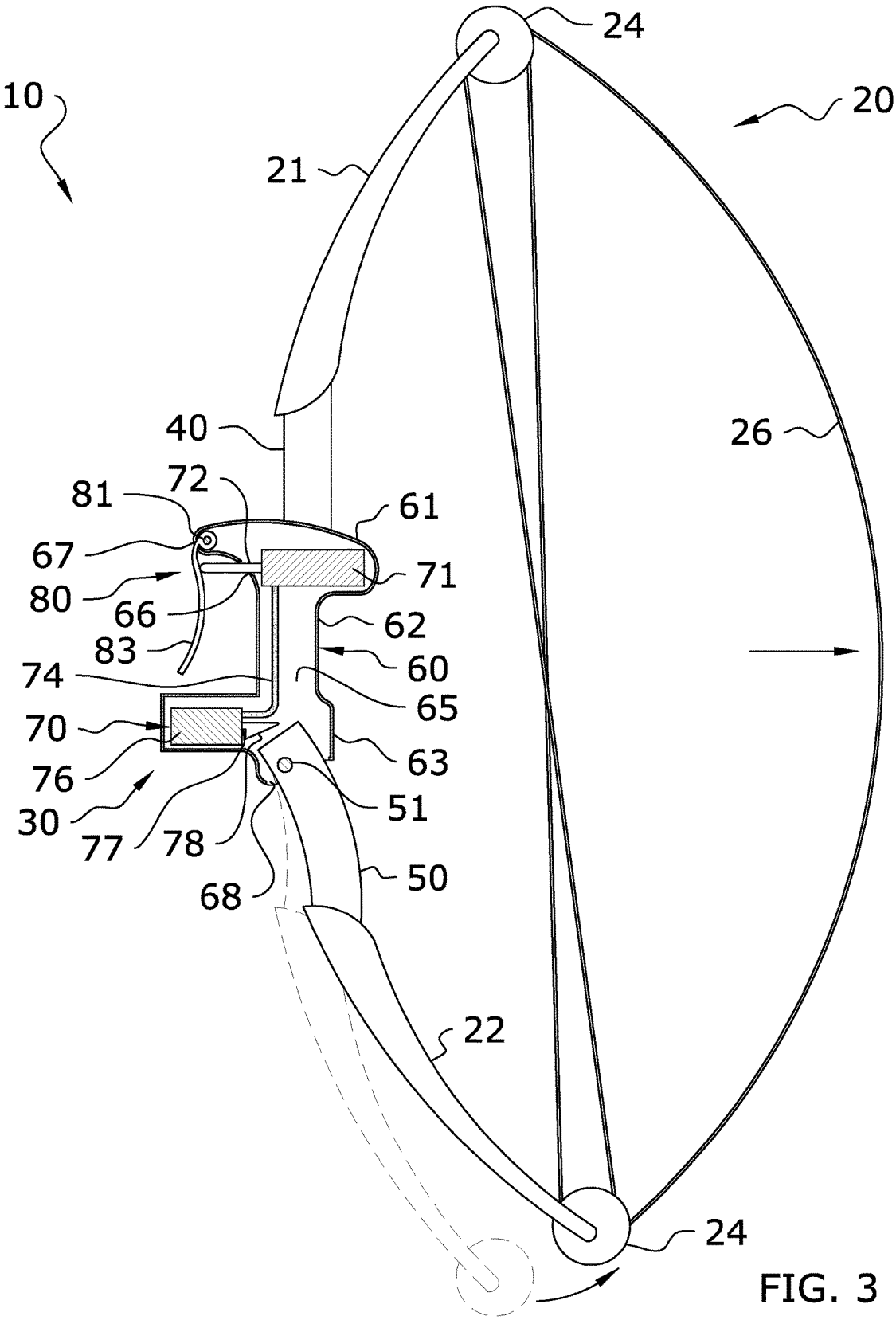
FIG. 3 is a partial side sectional view of the present invention with the bowstring pulled in the drawn position and the lower limb pivoted rearwardly to define the draw weight.
Figure 4:
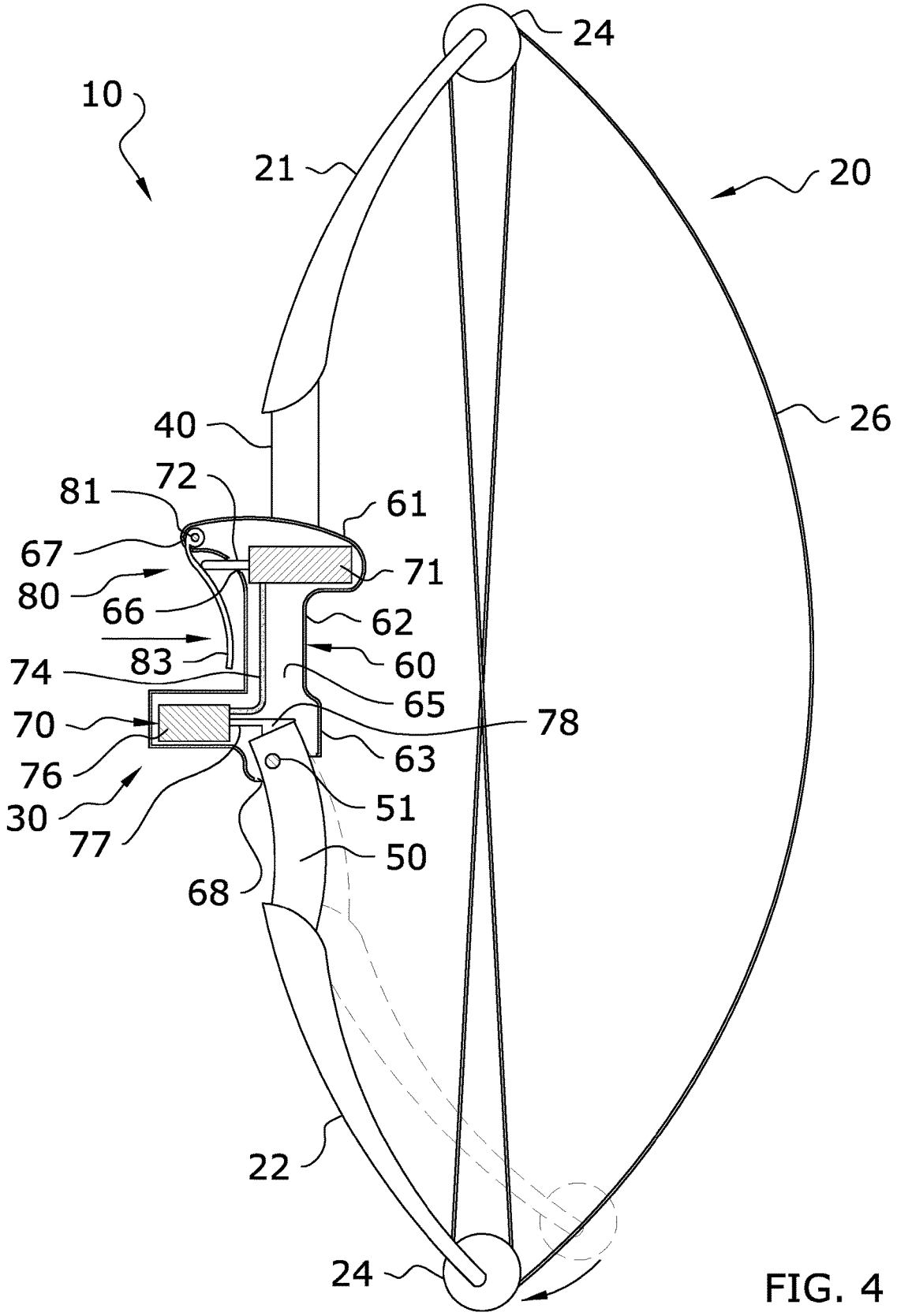
FIG. 4 is a partial side sectional view of the present invention with the bowstring pulled in the drawn position and the lower limb pivoted forwardly to define the throw weight.

As illustrated in FIG. 3, when the operator pulls back upon the drawstring 26 or prior to the operator pulling back upon the drawstring 26 the second end section 50 freely pivots or is pivoted rearwardly until the rear surface of the second end section 50 engages the rear surface of the end opening 68 thus stopping a pivotal movement of the second end section 50 and attached second limb 22. By pivoting the second end section 50 and second limb 22 rearwardly, the distal end of the second limb 22 that supports the drawstring 26 is moved angularly upwardly closer to the distal end of the first limb 21 thus shortening a distance between the distal ends of the first limb 21 and the second limb 22. By shortening the distance between the distal ends of the first limb 21 and the second limb 22, the force required to pull back upon the drawstring 26 to the drawn position lessens thus providing a lower draw weight.

When the drawstring 26 is in the drawn position, the fingers of the hand of the operator holding the handle portion 62 are extended forwardly around the front of the trigger member 83. When the operator is about to shoot or release the arrow, the trigger member 83 is depressed rearwardly towards the handle portion 62 by grasping the trigger member 83 and pivoting the trigger member 83 rearwardly.

When the trigger member 83 is pivoted rearwardly, the trigger member 83 pushes upon the first piston rod 72 of the actuating assembly 70, thus forcing the first piston rod 72 within the master cylinder 71. The fluid within the master cylinder 71 is then caused to be directed through the connecting hose 74 to the slave cylinder 76, which fluid entering the slave cylinder 76 then causes the second piston rod 77 to extend outwardly from the slave cylinder 76 and the wedge 78 of the second piston rod 77 to engage the end of the second end section 50 thus causing pivotal movement of the second end section 50 and second limb 22 as illustrated in FIG. 4.

The second end section 50 is pivoted forwardly until a front surface of the second end section 50 engages a front of the end opening 68 or until the second piston rod 77 ceases to extend rearwardly. The operator may adjust the amount that the second piston rod 77 extends forwardly by depressing the trigger member 83 a selective amount, thus operatively adjusting the pivotal degree that the second end section 50 is rotated and change in force of the drawstring 26.

By pivoting the second end section 50 and second limb 22 forwardly, the distal end of the second limb 22 that supports the drawstring 26 is moved angularly downwardly further from the distal end of the first limb 21 thus lengthening a distance between the distal ends of the first limb 21 and the second limb 22. By lengthening the distance between the distal ends of the first limb 21 and the second limb 22, the throwing or releasing force of the drawstring 26 is made greater thus being able to throw or release the arrow at a greater force and higher speed than would otherwise be consistent with the draw weight. The increased throw weight is generally substantially greater than the draw weight, such as twice or three times the draw weight.

The trigger member 83 is held at the current depressed state as the drawstring 26 is released to ensure that the arrow smoothly releases from the drawstring 26 at the increased throw weight. After releasing the arrow and having the drawstring 26 move back to the rested position, the second end section 50 may be pivoted rearwardly thus allowing the second piston rod 77 to retract which directs the fluid back within the master cylinder 71 and causes the first piston rod 72 to extend and move the trigger member 83 back to an initial position. It is appreciated that various mechanisms may be used to return the trigger member 83 and fluid back to the initial position.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An archery bow having an operative riser, a first limb extending outwardly from said riser, a second limb extending outwardly from said riser on an opposite end, and a drawstring supported between distal ends of said first and second limbs for propelling an arrow, said riser comprising:

a first end section connected to said first limb;

a second end section connected to said second limb;

a central section connected between said first and second end sections, said first end section being fixedly connected to said central section and said second end section being pivotally connected to said central section;

an actuating means disposed within an internal cavity of said central section to physically engage said second end section; and a triggering means connected to said actuating means to operably engage said actuating means and cause pivotal movement of said second limb, said pivotal movement changing a length between said distal ends of said first and second limbs thus changing a draw or throw weight of said drawstring.

2. The operative riser of claim 1, wherein said central section has a handle portion.

3. The operative riser of claim 2, wherein said triggering means is positioned forwardly of said handle portion.

4. The operative riser of claim 1, wherein said triggering means directly contacts said actuating means in a depressed state of said triggering means.

5. The operative riser of claim 1, wherein a pivotal end of said second end section extends within an end opening of said central section to be engaged by said actuating means.

6. The operative riser of claim 1, wherein said actuating means includes:

a master cylinder positioned within a first portion of said central section and having a first piston rod;

said first piston rod extending forwardly from said central section to be engaged by said triggering means; and a slave cylinder positioned within a second portion of said central section and having a second piston rod;

said slave cylinder fluidly connected to said master cylinder and said second piston rod extending rearwardly from said slave cylinder to engage said second end section when said first piston rod retracts within said master cylinder.

7. The operative riser of claim 6, wherein said central section includes a handle portion positioned between said first portion and said second portion.

8. The operative riser of claim 6, wherein said master cylinder is horizontally oriented within said first portion and said slave cylinder is horizontally oriented within said second portion.

9. The operative riser of claim 6, wherein said second piston rod includes a wedge located at a distal end of said second piston rod.

10. The operative riser of claim 9, wherein a tapering surface of said wedge engages an end of said second end section to cause said second end section to pivot.

11. The operative riser of claim 1, wherein said triggering assembly includes a trigger member, wherein said trigger member is comprised of a spline-shape.

12. The operative riser of claim 1, said archery bow comprised of a compound bow.

13. A method of operating an archery bow to enable said bow to have a high throw weight while having a low draw weight, said method comprising;

pivoting a first limb of said archery bow inwardly towards a first pivotal position, said first pivotal position setting a draw weight of a drawstring of said archery bow;

pulling said drawstring from a rested position to a drawn position;

engaging an actuating means disposed within a riser of said archery bow, said actuating means causes pivotal movement of said first limb;

pivoting said first limb outwardly towards a second pivotal position, said second pivotal position setting a throw weight of said drawstring of said archery bow, said throw weight being greater than said draw weight;

retaining a second limb of said archery bow in a fixed position while pivoting said first limb to said first pivotal position and said second pivotal position; and releasing said drawstring from said drawn position causing an arrow to be released at said throw weight while retaining said first limb in said second pivotal position.

14. The method of claim 13, including a step of depressing a trigger member to engage said actuating means.

15. The method of claim 14, wherein said trigger member is supported forwardly of a handle portion of said riser.

16. The method of claim 14, including a step of depressing said trigger member a selective distance, said selective distance relative to a pivotal degree of said first limb.

17. The method of claim 13, wherein said actuating step includes:

providing a master cylinder having a first piston rod extending therefrom;

providing a slave cylinder having a second piston rod extending therefrom, said slave cylinder fluidly connected to said master cylinder;

retracting said first piston rod within said master cylinder;

causing a fluid within said master cylinder to flow to said slave cylinder;

said fluid entering said slave cylinder causing said second piston rod to extend from said slave cylinder;

engaging a pivotal section of said riser with said second piston rod; and pivoting said pivotal section of said riser.

18. The method of claim 17, wherein said second piston rod has a wedge at a distal end for engaging said pivotal section of said riser.

19. A compound archery bow having an operative riser, a first limb extending outwardly from said riser, a second limb extending outwardly from said riser on an opposite end, and a drawstring supported between distal ends of said first and second limbs for propelling an arrow, said riser comprising:

a first end section connected to said first limb;

a second end section connected to said second limb;

a central section connected between said first and second end sections, said first end section being fixedly connected to a first portion said central section and said second end section being pivotally connected to a second portion said central section;

wherein said central section has a handle portion extending between said first portion and said second portion;

wherein said central section has an internal cavity extending throughout said first portion, said second portion, and said handle portion;

an actuating assembly disposed within said internal cavity of said central section;

wherein said actuating assembly includes a master cylinder horizontally positioned within said first portion of said central section;

wherein said master cylinder includes a first piston rod retractably extending within said master cylinder, wherein said first piston rod extends through a front opening of said central section forwardly of said handle portion;

wherein said actuating assembly includes a slave cylinder horizontally positioned within said second portion of said central section;

wherein said actuating assembly includes a connecting hose fluidly connecting said master cylinder to said slave cylinder to allow a transfer of fluid therebetween;

wherein said slave cylinder includes a second piston rod retractably extending within said slave cylinder, wherein said second piston rod includes a wedge at a distal end of said second piston rod, said wedge having a tapered surface to selectively engage an angled end of said second end section; and a trigger assembly having a pivotal connector connected to said central section and a trigger member extending therefrom forwardly of said handle portion;

said trigger member physically contacting said first piston rod to operably engage said master cylinder and cause said fluid to be transferred from said master cylinder to said slave cylinder to extend said second piston rod and cause pivotal movement of said second limb via pivotal movement of said second end section, said pivotal movement changing a length between said distal ends of said first and second limbs thus changing a draw or throw weight of said drawstring.

* * * * *